US006518529B2

(12) United States Patent
Bonn et al.

(10) Patent No.: US 6,518,529 B2
(45) Date of Patent: Feb. 11, 2003

(54) PUSHBUTTON FOR LATCHING AND MOMENTARY CONTACT FUNCTIONS

(75) Inventors: Alfred Bonn, Bonn (DE); Artur Wiese, Koblenz (DE)

(73) Assignee: Moeller GmbH, Bonn (DE)

( * ) Notice: Subject to any disclaimer, the term of this patent is extended or adjusted under 35 U.S.C. 154(b) by 0 days.

(21) Appl. No.: 09/913,477

(22) PCT Filed: Dec. 11, 2000

(86) PCT No.: PCT/EP00/12506

§ 371 (c)(1),
(2), (4) Date: Aug. 15, 2001

(87) PCT Pub. No.: WO01/45124

PCT Pub. Date: Jun. 21, 2001

(65) Prior Publication Data

US 2002/0157935 A1 Oct. 31, 2002

(30) Foreign Application Priority Data

Dec. 16, 1999 (DE) ..... 199 60 695

(51) Int. Cl.[7] ..... H01H 13/14
(52) U.S. Cl. ..... 200/520; 200/524; 200/341
(58) Field of Search ..... 200/520, 523, 200/524, 525, 341, 566, 567, 16 R

(56) References Cited

U.S. PATENT DOCUMENTS 4,218,598 A * 8/1980 Iwasaki et al. ..... 200/153 J
4,368,368 A * 1/1983 Russenberger ..... 200/153 J
5,262,606 A 11/1993 Benson et al.
5,369,237 A 11/1994 Mejerl et al.
5,380,970 A * 1/1995 Mizuno et al. ..... 200/523
5,384,442 A * 1/1995 Danner ..... 200/566
5,579,903 A * 12/1996 McEvilly et al. ..... 200/524
5,841,085 A * 11/1998 Rittinghaus et al. ..... 200/16 R
6,326,572 B1 * 12/2001 Yu ..... 200/524

FOREIGN PATENT DOCUMENTS

| | | |
|---|---|---|
| CH | 595687 | 2/1978 |
| DE | 292106 | 7/1991 |
| DE | 4202214 | 7/1993 |
| EP | 0676780 | 10/1995 |
| FR | 2322442 | 3/1977 |
| FR | 2373863 | 7/1978 |

* cited by examiner

*Primary Examiner*—Elvin Enad
*Assistant Examiner*—Kyung S. Lee
(74) *Attorney, Agent, or Firm*—Davidson, Davidson & Kappel, LLC

(57) ABSTRACT

A pushbutton for latching and momentary contact functions that is used to actuate contact elements includes a hollow cylindrical housing and a switch plunger displaceable in a lengthwise direction and non-rotatably guided in the housing. An open ring element is rotatably supported on the switch plunger. A spring and stop device for enabling a resting position of the pushbutton is provided. The housing includes an approximately heart-shaped latching guideway for the latching function disposed at an inside wall of the housing. The housing also includes a longitudinal groove for the momentary-contact function and disposed at the inside wall of the housing approximately parallel to the latching guideway and to an actuating direction. Also provided is a guide pin capable of being repositioned between the latching guideway and the longitudinal groove using a tool through an access opening defined by the housing. The guide pin projects radially outward from the open ring element.

5 Claims, 2 Drawing Sheets

PUSHBUTTON FOR LATCHING AND MOMENTARY CONTACT FUNCTIONS

BACKGROUND

The present invention relates generally to a pushbutton for latching and momentary contact functions used for actuating at least one contact element, and specifically to a pushbutton including a latching guideway and longitudinal groove formed in an inside wall of a housing and a guide pin projecting radially outward from an open ring element supported on a switch plunger.

Swiss Patent Publication CH 595 687 A5 describes a pushbutton of this kind which is composed of a hollow cylindrical housing and a switch plunger which is lengthwise displaceable and non-rotatably guided therein. The switch plunger is biased toward the resting position via a helical pressure spring for which purpose provision is made for stop bosses on the switch plunger and corresponding stop faces on the housing. An approximately heart-shaped coulisse, or latching guideway, and, parallel thereto and separate therefrom, a longitudinal groove running essentially in the actuating direction are recessed into the outer wall of the switch plunger. A wire-shaped spring element which runs essentially in the actuating direction and whose offset free end is configured as a guide pin is supported in the housing. To implement the latching function or momentary contact function, the guide pin runs in the latching guideway or in the longitudinal groove, respectively, and can be repositioned from the latching guideway to the longitudinal groove or vice versa by means of a pointed tool which reaches through an access opening in the housing. The complex bearing and the design of the spring element which requires additional spring means and which consequently requires space constitute a disadvantage. Moreover, the guide pin is difficult to be accessed during repositioning and its actual position is recognizable only when one looks very carefully.

Furthermore, an illuminated pushbutton with latching function having the type designation RLTR of the company Moeller GmbH is known in which the heart-shaped latching guideway is recessed into the inside wall of the housing and in which the guide pin engaging with the latching guideway projects outward from an open metal ring which is supported on the switch plunger. To increase reliability, the housing is equipped with two latching guideways arranged opposite and the spring ring is equipped with guide pins mutually opposing each other.

SUMMARY OF THE INVENTION

An object of the present invention is to provide a pushbutton for latching and momentary contact functions featuring a simple and space-saving support of the guide pin and allowing the operating mode to be changed in an easy and recognizable manner.

The present invention provides a pushbutton for latching and momentary contact functions. The pushbutton includes: a hollow cylindrical housing; a switch plunger displaceable in a lengthwise direction and non-rotatably guided in the housing; an open ring element rotatably supported on the switch plunger; a spring and stop device for enabling a resting position of the pushbutton; an approximately heart-shaped latching guideway defined by the housing, the latching guideway being for the latching function and being disposed at an inside wall of the housing; a longitudinal groove defined by the housing and disposed at the inside wall of the housing approximately parallel to the latching guideway and to an actuating direction, the longitudinal groove being for the momentary-contact function; and a guide pin capable of being repositioned between the latching guideway and the longitudinal groove using a tool through an access opening defined by the housing, the guide pin projecting radially outward from the open ring element.

Because the latching guideway, or coulisse, and the longitudinal groove are formed at the inside wall of the housing and the guide pin is formed as a part of the ring element, no additional space is required compared to a pushbutton which is exclusively provided with a latching function or with a momentary contact function. The open ring element is suited to be snapped onto a corresponding annular groove on the switch plunger during assembly and to be subsequently supported there in a manner that it is easily displaceable. Via the access opening, the outwardly facing guide pin can easily be moved clockwise or counterclockwise using a suitable pointed tool, the respective end position of the guide pin which is easily visible through the access opening clearly showing the operating mode of the pushbutton.

The present invention may also provide a cross connection which connects the latching guideway and the longitudinal groove approximately at half the height. Because of this, the guide pin can be deliberately repositioned only when the pushbutton is in the half-depressed position, whereas in the two end positions an intentional repositioning or an unintentional repositioning caused by vibrations or shaking are ruled out. Expediently, the cross connection can at the same time be configured as an access opening.

In an embodiment of the present invention, the latching guideway and/or the longitudinal groove has/have a configuration which runs out at the front side to enable the guide pin to easily enter into the latching guideway or the longitudinal groove during the assembly of the pushbuttons. An opposed arrangement of the guide elements appertaining to the latching and momentary contact functions serves the reliable operation of the pushbutton.

BRIEF DESCRIPTION OF THE DRAWINGS

Further details and advantages of the present invention follow from the following exemplary embodiment which will be explained on the basis of Figures.

DETAILED DESCRIPTION

Figure 1:
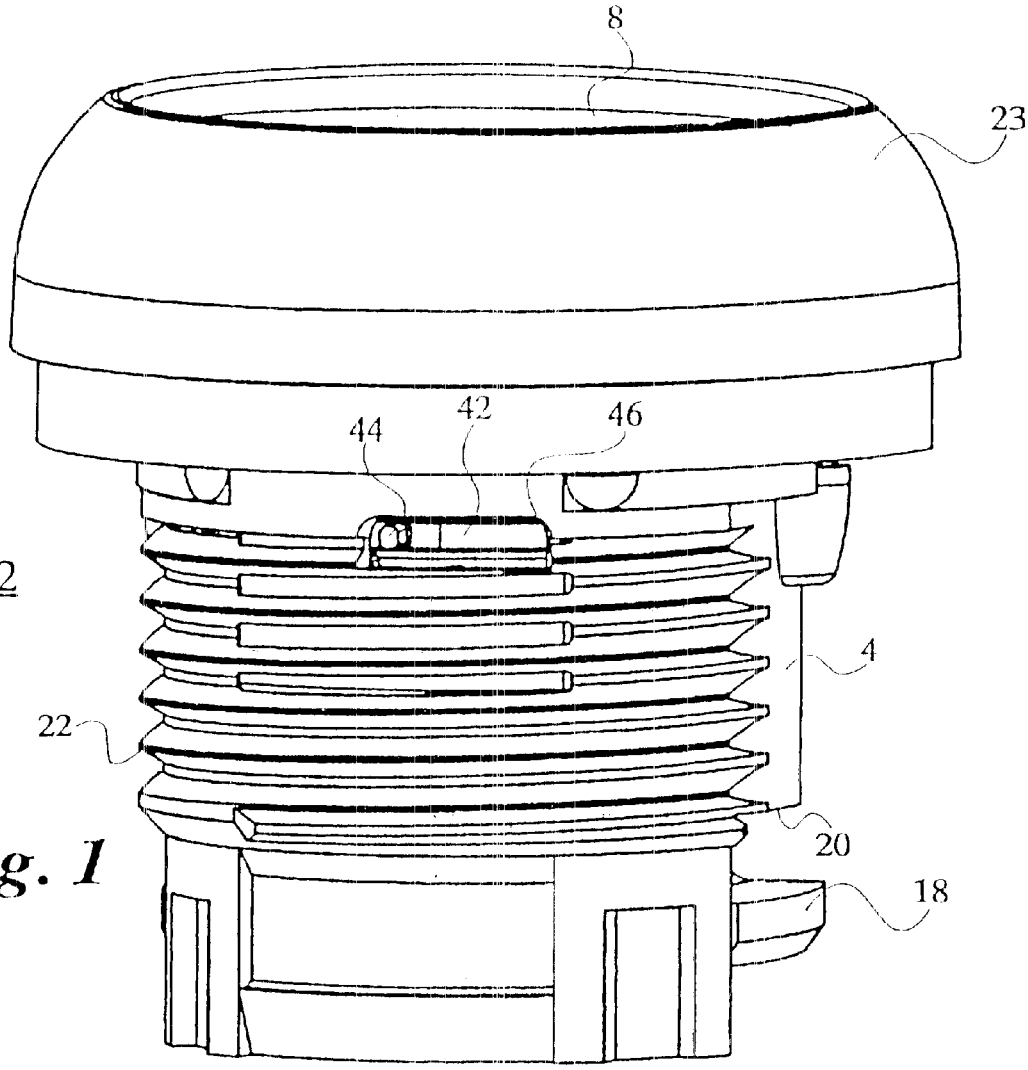
FIG. 1 is a perspective view of a pushbutton according to the present invention in a half-depressed position.

Pushbutton 2 for latching and momentary contact functions includes hollow cylindrical housing 4 and a switch plunger 6 which is lengthwise displaceable and non-rotatably guided therein. At the front face, switch plunger 6 is provided with an actuating element 8 which can be illuminated at the rear by a light source which is not shown. Switch plunger 6 is biased forward, that is in a direction opposite to actuating direction 16 by a helical pressure spring which is not shown either and which is put around the lower part 10 of switch plunger 6 and braced between a ring surface 12 facing to the rear at the middle part of switch plunger 6 and a partial ring surface 14 of housing 4 facing to the front. When inserting switch plunger 6 into housing 4, the two radially projecting elastic plunger ends 18 are snapped behind rear stop faces 20 of housing 4 and, in cooperation with the pressure spring, subsequently assure that pushbutton 2 assumes the resting position. Reference number 22 denotes an external thread on which a mounting nut can be screwed onto housing 4 from behind. Switch plunger 6 is retained in housing 4 by a snap-on front ring 23.

Figure 3:
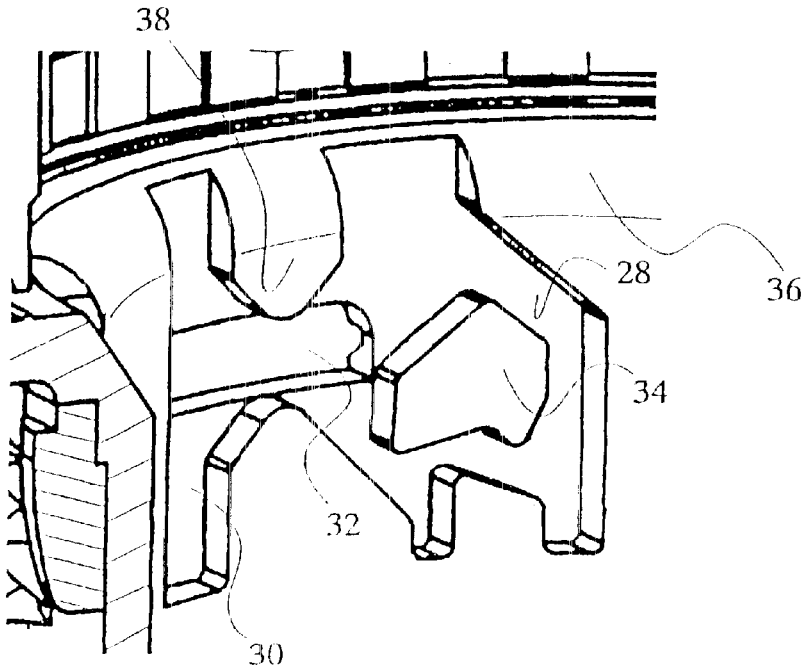
FIG. 3 shows a detail of FIG. 2.
Figure 2:
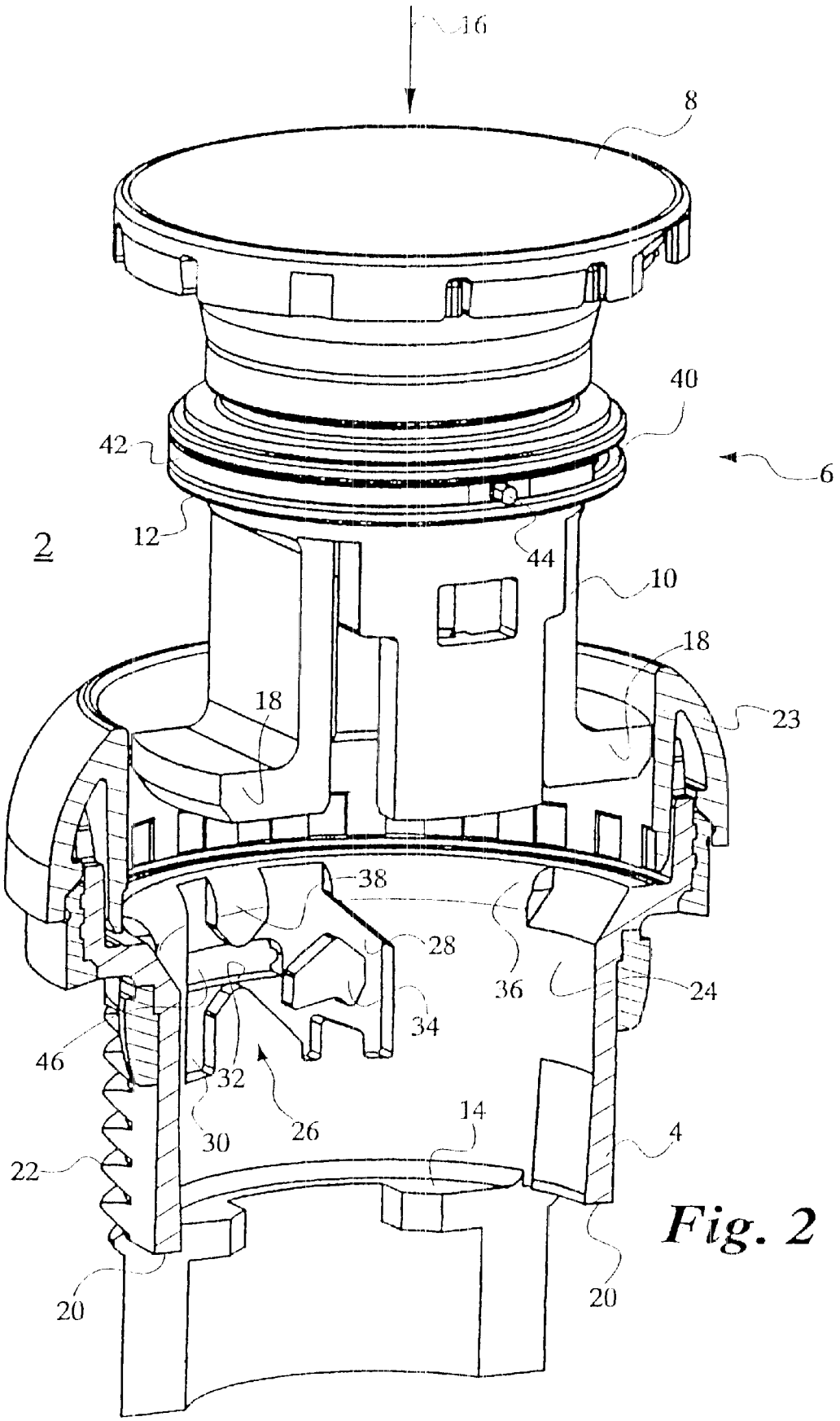
FIG. 2 shows the pushbutton according to FIG. 1 in a partially broken-away and pulled-apart perspective view.

Cylindrical inside wall 24 of housing 4 is provided with two diametrically opposing recesses 26 of which only the rear one is discernible in FIG. 2 and FIG. 3. Each of these recesses 26 is composed of an approximately heart-shaped latching guideway, or coulisse, 28, a longitudinal groove 30 running approximately parallel to the latching guideway and in actuating direction 16, as well as a cross connection 32 which connects latching guideway 28 and longitudinal groove 30 approximately in the middle of their height. Latching guideway 28 runs around an approximately inverted heart-shaped island 34. Latching guideway 28 and longitudinal groove 30 run, or extend, out toward the front, or outer, side of housing 4 into an inner rounding-out, or filleting, 36 of housing 4 and are separated underneath this location by a tongue-like segment 38. An open ring element 42 is supported in an annular groove 40 in the middle part of switch plunger 6 in a manner that it can be rotated easily. Two diametrically opposing guide pins 44 are formed on ring element 42 of which only the front one is discernible in FIG. 1 and FIG. 2. During the actuation of pushbutton 2, guide pins 44 slide along either inside latching guideways 28 or inside longitudinal grooves 30. In the first case, pushbutton 2 works in latching mode, respective guide pin 44 latching underneath the inverted heart-shaped island 34 in the depressed position. In the second case, pushbutton 2 works in momentary contact mode. As is discernible in FIG. 1, guide pin 44 is visible at least on one side through an access opening 46 molded into housing 4 when switch plunger 6 is in the half-depressed position. In this half-depressed position of pushbutton 2, guide pin 44 can be displaced clockwise or counterclockwise with the aid of a suitable tool which reaches through access opening 46. In the process, guide pins 44 slide along cross connection 32 to get from latching guideway 28 into longitudinal groove 30 or vice versa. At cross connection 32, the back wall is omitted because access opening 46 is formed at the same location.

What is claimed is:

1. A pushbutton for latching and momentary contact functions, the pushbutton comprising:

a hollow cylindrical housing;

a switch plunger displaceable in a lengthwise direction and non-rotatably guided in the housing;

an open ring element rotatably supported on the switch plunger;

a spring and stop device for enabling a resting position of the pushbutton;

an approximately heart-shaped latching guideway defined by the housing, the latching guideway being for the latching function and being disposed at an inside wall of the housing;

a longitudinal groove defined by the housing and disposed at the inside wall of the housing approximately parallel to the latching guideway and to an actuating direction, the longitudinal groove being for the momentary-contact function; and a guide pin capable of being repositioned between the latching guideway and the longitudinal groove using a tool through an access opening defined by the housing, the guide pin projecting radially outward from the open ring element.

2. The pushbutton as recited in claim 1 further comprising a cross connection configured for connecting the latching guideway and the longitudinal groove at approximately half a height of the latching guideway and the longitudinal groove.

3. The pushbutton as recited in claim 1 further comprising a cross connection configured for connecting the latching guideway and the longitudinal groove at approximately half a height of the latching guideway and the longitudinal groove, the cross connection coinciding with the access opening.

4. The pushbutton as recited in claim 1 wherein at least one of the latching guideway and the longitudinal groove extend out toward a front side of the housing.

5. The pushbutton as recited in claim 1 further comprising:

a second approximately heart-shaped latching guideway defined by the housing, the second latching guideway being for the latching function and being disposed at the inside wall of the housing;

a second longitudinal groove defined by the housing and disposed at the inside wall of the housing approximately parallel to the second latching guideway and to the actuating direction, the second longitudinal groove being for the momentary-contact function; and a second guide pin capable of being repositioned between the second latching guideway to the second longitudinal groove using the tool through a second access opening defined by the housing, the second guide pin projecting radially outward from the open ring element;

wherein the second latching guideway is disposed opposite the latching guideway, the second longitudinal groove is disposed opposite the longitudinal groove, and the second guide pin is disposed opposite the guide pin.

* * * * *